US007204322B2

(12) United States Patent
Sakai

(10) Patent No.: US 7,204,322 B2
(45) Date of Patent: Apr. 17, 2007

(54) POWER TOOL HAVING PNEUMATIC VIBRATION DAMPENING

(75) Inventor: Mitsunori Sakai, Anjo (JP)

(73) Assignee: Makita Corporation, Anjo-shi, Aichi-ken (JP)

( * ) Notice: Subject to any disclaimer, the term of this patent is extended or adjusted under 35 U.S.C. 154(b) by 188 days.

(21) Appl. No.: 10/902,717

(22) Filed: Jul. 29, 2004

(65) Prior Publication Data

US 2005/0023017 A1 Feb. 3, 2005

(30) Foreign Application Priority Data

Jul. 31, 2003 (JP) ..... 2003-204411
May 28, 2004 (JP) ..... 2004-160077

(51) Int. Cl.
*B25D 9/00* (2006.01)

(52) U.S. Cl. ..... 173/162.1; 173/217; 173/2; 173/117; 173/176; 74/574.4

(58) Field of Classification Search ..... 173/162.1, 173/48, 217, 201, 210, 212; 74/574.4, 603, 74/604

See application file for complete search history.

(56) References Cited

U.S. PATENT DOCUMENTS 3,688,848 A * 9/1972 Vick et al. ..... 173/201
4,014,392 A * 3/1977 Ross ..... 173/118
4,895,212 A * 1/1990 Wache ..... 173/48
5,014,793 A * 5/1991 Germanton et al. ..... 173/181
5,678,641 A * 10/1997 Manschitz et al. ..... 173/114
6,520,266 B2 * 2/2003 Bongers-Ambrosius et al. ..... 173/2
6,763,897 B2 * 7/2004 Hanke et al. ..... 173/210
6,913,088 B2 * 7/2005 Berger ..... 173/48
2004/0222001 A1 * 11/2004 Ikuta et al. ..... 173/210
2006/0076154 A1 * 4/2006 Aoki ..... 173/212

FOREIGN PATENT DOCUMENTS

JP 51-6583 1/1976

* cited by examiner

*Primary Examiner*—Brian Nash
(74) *Attorney, Agent, or Firm*—Orrick, Herrington & Sutcliffe LLP

(57) ABSTRACT

It is an object of the present invention to provide a vibration reducing technique caused by air pressure fluctuations within a power tool. According to the present invention, a representative power tool may comprise a driving motor, a driver and a tool bit. The driving motor drives the driver to cyclically reciprocate. The tool bit is linearly driven by utilizing the pressure of air within the power tool. The air may be compressed by the reciprocating movement of the driver. The power tool changes the rotational speed of the driving motor in the cycle of the reciprocating movement of the driver so that vibration caused in the power tool can be alleviated.

9 Claims, 10 Drawing Sheets

119
133
131
117
129
127
125
124
129a
θ

119
133
131
117
129
127
125
124
129a
P
θ

| A1 | Δf |
|---|---|
| As<A1≦Ax | fx |
| Ax<A1≦Ay | fy |
| Ay<A1 | fz |

POWER TOOL HAVING PNEUMATIC VIBRATION DAMPENING

CROSS REFERENCE

This application claims priority to Japanese patent application number 2003-204411, filed Jul. 31, 2003 and Japanese patent application number 2004-160077, filed May 28, 2004, each of which are incorporated herein by reference as if fully set forth herein.

BACKGROUND OF THE INVENTION

1. Field of the Invention

The present invention relates to a power tool such as an electric hammer and more particularly, to a technique of reducing and alleviating vibration in a power tool.

2. Description of the Related Art

A known power tool such as an electric hammer generally includes a driving motor, a driver driven by the driving motor to reciprocate and a tool bit. The known electric hammer linearly drives a driven-side member, such as a striker by utilizing the pressure fluctuation of air within the power tool. Such air is compressed by a reciprocating movement of the driver. When the driven-side member is linearly driven, the tool bit is also linearly driven, so that the tool bit performs a predetermined operation.

In the known electric hammer, the fluctuation of air pressure for driving the tool bit may cause vibration in the electric hammer. That means the driver linearly drives the driven-side member by the pressure of the compressed air, and the driven-side member drives the tool bit. At this time, typically, all of the driving force of the driven-side member is not turned into a driving force of the tool bit. In many cases, part of the driving force of the driven-side member is turned into repulsion that the driven-side member receives in a direction away from the hammer bit. In such a case, the driven-side member may retract at high speed toward the driver. As a result, undesired compression of air may occur and cause undesired vibration toward the rear side of the power tool or toward the user holding the power tool.

As an example of measures for reducing vibration in a power tool, Japanese non-examined laid-open Utility Model Publication No. 51-6583 discloses a technique of reducing vibration using a counter weight. The counter weight reciprocates in a direction opposite to the striker. In this manner, vibration caused in the electric hammer, particularly in the axial direction of the tool bit, can be effectively reduced. However, the counter weight may not always effectively reduce vibration caused by air fluctuations within the electric hammer.

SUMMARY OF THE INVENTION

It is an object of the present invention to provide a vibration reducing technique caused by air pressure fluctuations within a power tool.

According to the present invention, a representative power tool may include a driving motor, a driver and a tool bit. The driving motor drives the driver to cyclically reciprocate. The tool bit is linearly driven by utilizing the pressure of air within the power tool. The air may be compressed by the reciprocating movement of the driver. The power tool changes the rotational speed of the driving motor in the cycle of the reciprocating movement of the driver so that vibration caused in the power tool can be alleviated. Other objects, features and advantages of the present invention will be readily understood after reading the following detailed description together with the accompanying drawings and the claims.

DETAILED DESCRIPTION OF THE INVENTION

Figure 1:
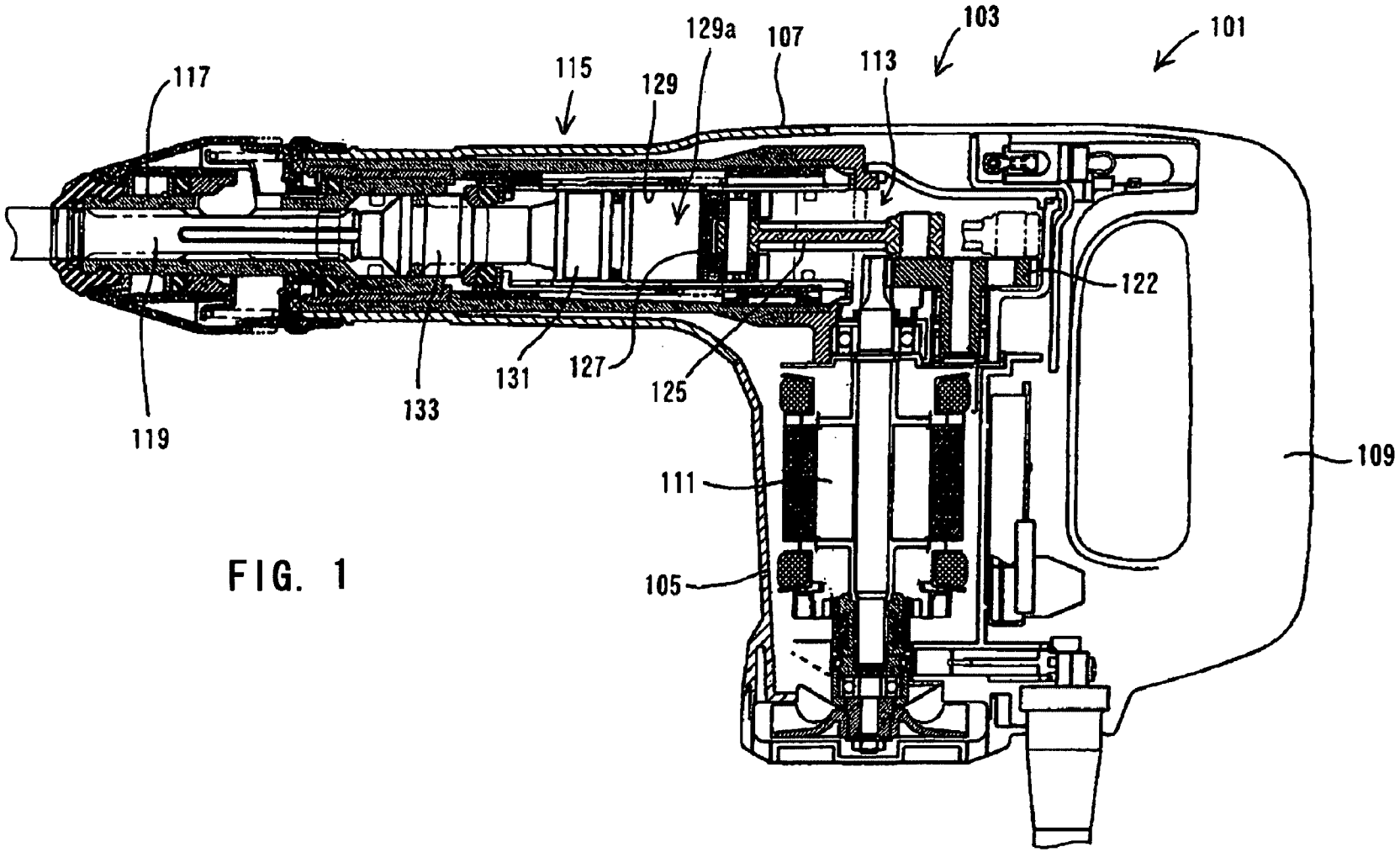
FIG. 1 is a sectional view schematically showing an entire electric hammer according to the first representative embodiment of the invention.

The representative power tool may include a driving motor, a driver driven by the driving motor to cyclically reciprocate and a tool bit linearly driven by utilizing the pressure of air within the power tool compressed by the reciprocating movement of the driver. The representative power tool may change the rotational speed of the driving motor in the cycle of the reciprocating movement of the driver to alleviate vibration caused by pressure fluctuation of an air compressed by the driver.

As the driving motor of the present invention, either a DC motor or an AC motor can be suitably used. For example, a three-phase DC brushless motor or a three-phase induction motor may preferably be used which can control its speed by an inverter. The driver may include, for example, a piston-like driving member that slides within the cylinder, or a cylinder-like driving member that has a hollow space inside and can reciprocate. The tool bit may preferably be indirectly driven via intervening members such as a striker and an impact bolt. The intervening members may be driven by the driver. Air compression is necessary only at least either between the driver and the intervening member or between the intervening members. For example, an electric hammer may typically define the power tool according to the invention. However, this invention can also be applied to other power tools, such as a nail driving machine.

In such a power tool in which the tool bit is driven by utilizing the air compressing action of the driver, vibration may be caused by fluctuations of air pressure as a result of the reciprocating movement of the driver. Typically, the driver linearly drives a driven-side member, such as a striker, by utilizing the pressure of the compressed air, and the driven-side member drives the tool bit (for example, the striker strikes the tool bit or the intervening member between the striker and the tool bit). Generally, at this time, all of the driving force of the driven-side member is not turned into a driving force of the tool bit. In such case, part of the driving force of the driven-side member is usually turned into repulsion that the driven-side member receives in a direction away from the hammer bit. As a result, the driven-side member may retract at high speed toward the driver. Thus, undesired compression of air may occur by the driven-side member retracting at high speed toward the driver. In this case, the air compression by the driven-side member moving at high speed in a direction away from the tool bit may cause undesired vibration toward the rear side of the power tool or toward the user holding the power tool.

According to the present invention, in order to accommodate with the vibration (reaction) caused in the power tool in a direction away from the tool bit, the representative power tool changes the rotational speed of the driving motor in cycle based on an index relating to the position of the reciprocating driver. For example, the driving frequency of the driving motor may be changed. In the above-mentioned exemplary case, preferably, when the driven-side member retracts at high speed due to repulsion that the driven-side member receives in a direction away from the hammer bit, the driver may be caused to retract at higher speed. Thus, the air compressing action of the driven-side member that has started retracting at high speed can be efficiently alleviated by the driver retracting at faster than normal speed. As a result, the undesired air compressing action caused by the retracting movement of the driven-side member can be alleviated, so that vibration caused in the power tool can be reduced. In changing the rotational speed of the driving motor, the invention does not exclude adopting a single-phase motor driven by phase control of an AC waveform.

According to the present invention, vibration reduction in the power tool can be achieved by controlling the rotational speed of the driving motor which is an already-existing component of the power tool. Therefore, compared with known vibration reducing method, the power tool can be simplified in structure.

As one aspect of the present invention, the rotational speed of the driving motor utilized in the representative power tool may preferably be changed based on an index relating to a position of the reciprocating driver. The "index" relating to the position of the driver suitably includes not only the information about the operational position of the driver itself within the power tool, but parameters, for example, about the position and angle of rotation of a member for driving the driver and also parameters about the positional information of a driven-side member that is driven by the driver.

Moreover, as another aspect of the present invention, the rotational speed of the driving motor according to the representative power tool may preferably be changed based on an index relating to a position of the reciprocating driver and an index relating to repulsion that the tool bit receives from the work-piece because of the following grounds.

When the tool bit is driven by air compression of the driver and performs a predetermined operation on the work-piece, vibration may be caused in the power tool by the pressure fluctuations of the air. The repulsion that the tool bit receives from the work-piece is greater when the work-piece has a higher hardness (e.g. rock). The repulsion acts in a rearward direction of the power tool (toward the user). Therefore, when the repulsion is greater, undesired air compressing action by the repulsion tends to become greater and cause greater undesired vibration in the rearward direction of the power tool.

Moreover, as to a known power tool that includes an idle driving prevention mechanism, when the power tool is driven in the state in which the work-piece is not in contact with the tool bit (i.e. in the case of idle driving), the air is not compressed by the reciprocating movement of the driver such that the power tool does not drive the tool bit. In such power tools, vibration caused by pressure fluctuations of air varies by the driving conditions and accordingly, the need for vibration reduction also varies.

In order to accommodate with the above-mentioned various situations, the rotational speed of the driving motor within the representative power tool may preferably be changed based on an index relating to the position of the reciprocating driver and an index relating to repulsion that the tool bit receives from the work-piece.

As a preferable example of the representative embodiment, the power tool may further include a driving force transmitting mechanism. The driving force transmitting mechanism converts a rotating output of the driving motor to a reciprocating movement via a crank arm and transmits the reciprocating movement to the driver. In such example, the position of the driver changes as the angle of rotation of the crank arm changes and therefore, "the index relating to the position of the driver" can be defined as information about the angle of rotation of the crank arm.

Practically, the angle of rotation of the crank arm may preferably be detected by using a proximity sensor disposed near the crank arm. Such detection can be more easily achieved than detection of the position of the sliding driver itself within the cylinder. As the proximity sensor, a magnetic or optical sensor can be suitably used.

As mentioned-above, the rotational speed of the driving motor may be increased by a predetermined amount according to the position of the driver when the driver is driven in a direction away from the tool bit. On the other hand, such increase of the rotational speed may preferably be compensated for by the amount of increase, so that driving cycles of the power tool can be prevented from being inappropriately fluctuated. Thus, the above-mentioned vibration reducing measures can be taken without changing the cycle of operation (namely, number of strokes of the tool bit per unit time), and more specifically, while keeping constant the average time required for one stroke of the tool bit (the average time required for the driver to return to the starting point on the top dead center).

Each of the additional features and method steps disclosed above and below may be utilized separately or in conjunction with other features and method steps to provide improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Representative Embodiment

Figure 2:
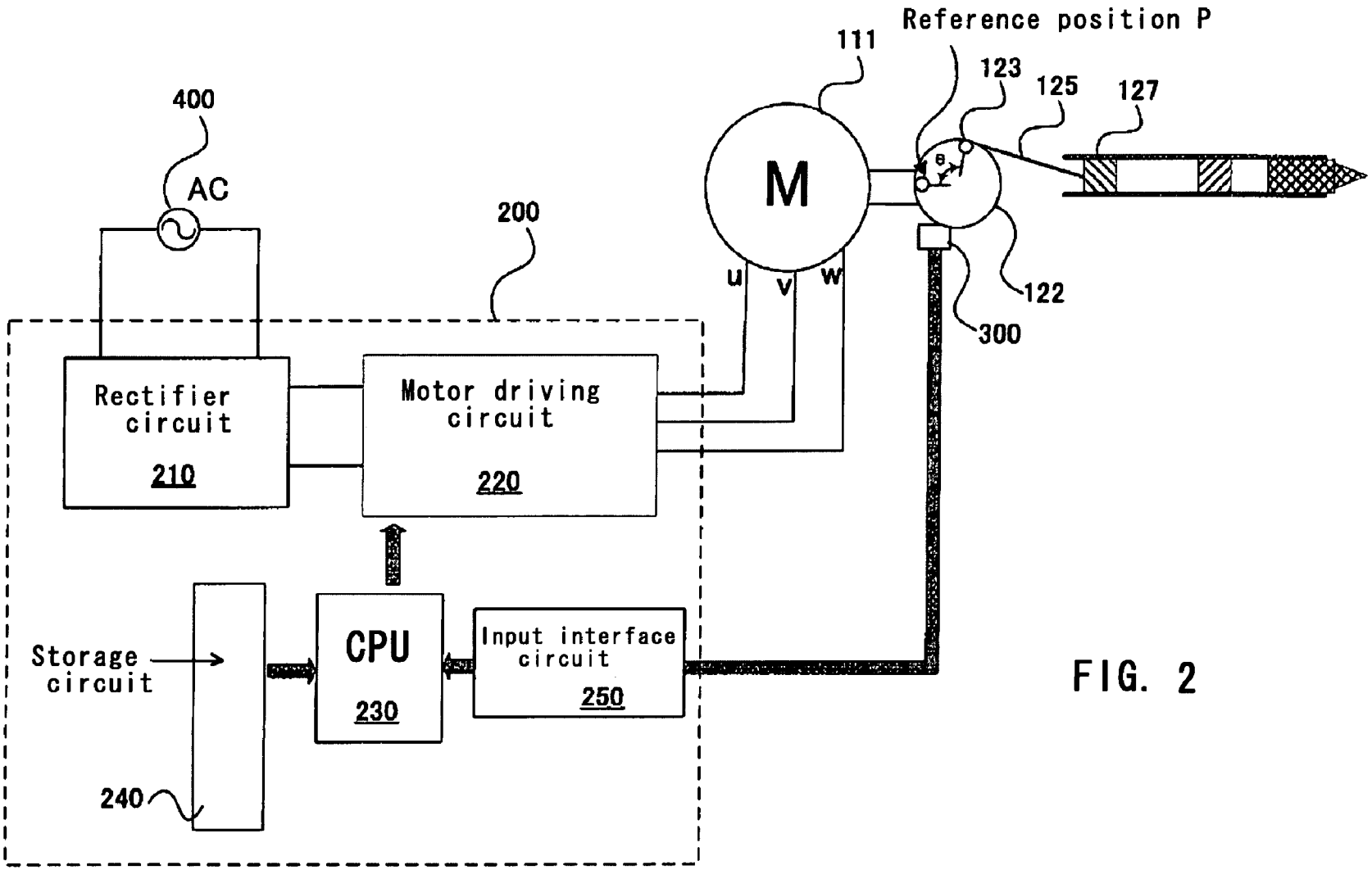
FIG. 2 is a block diagram of a control system of the electric hammer.

First representative embodiment of the present invention will now be described with reference to the drawings. FIGS. 1 and 2 show an electric hammer 101 as a representative embodiment of the power tool according to the present invention. FIG. 1 is a sectional view showing the entire electric hammer 101. FIG. 2 is a block diagram of the control system of the electric hammer 101 shown in FIG. 1.

As shown in FIG. 1, the representative electric hammer 101 includes a body 103, a tool holder 117 connected to the tip end region of the body 103, and a hammer bit 119 detachably coupled to the tool holder 117. The hammer bit 119 is a feature that corresponds to the "tool bit" according to the present invention.

The body 103 includes a motor housing 105 that houses a driving motor 111, a gear housing 107 that houses a driving force transmitting mechanism 113 and a striking mechanism 115, and a handgrip 109. The driving force transmitting mechanism 113 converts the rotating output of the driving motor 111 to linear motion and then transmits it to the striking mechanism 115. As a result, an impact force is generated in the axial direction of the hammer bit 119 via the striking mechanism 115.

The driving force transmitting mechanism 113 includes a driving gear 122, an eccentric shaft 123, a crank arm 124 and a connecting rod 125. The driving gear 122 is rotated in a horizontal plane by the driving motor 111. The eccentric shaft 123 is eccentrically disposed in a position displaced from the center of rotation of the driving gear 122. The crank arm 124 is disposed between the driving gear 122 and the eccentric shaft 123. One end of the connecting rod 125 is loosely connected to the eccentric shaft 123 and the other end is loosely connected to a driver 127. The driving gear 122, the eccentric shaft 123, the crank arm 124 and the connecting rod 125 are disposed within a crank chamber 121. Further, in the electric hammer 101 of this embodiment, a crank position angle detecting sensor 300 is appropriately disposed and detects a crank position angle (angle of rotation) of the crank arm 124 that is driven when the driving gear 122 rotates.

Further, the striking mechanism 115 includes a striker 131 and an impact bolt 133. The striker 131 is slidably disposed within a bore 129*a* of a cylinder 129 together with the driver 127. The impact bolt 133 is slidably disposed within the tool holder 117 and is adapted to transmit the kinetic energy of the striker 131 to the hammer bit 119.

The construction of the drive control system in the electric hammer 101 will now be explained with reference to FIG. 2. In this embodiment, the driving motor 111 includes a three-phase induction motor. A controller 200 for controlling the driving motor 111 includes a CPU 230, such as a microprocessor, a storage circuit 240 that comprises storage cells, such as RAM and ROM, an input interface circuit 250, a motor driving circuit 220 that outputs motor driving signals to the driving motor 111, and a rectifier circuit 210.

An AC power source 400 is connected to the input side of the rectifier circuit 210. The rectifier circuit 210 functions as an AC/DC converter for converting AC power to DC power. The AC power is converted into the DC power in the rectifier circuit 210 and the DC power is outputted to the motor driving circuit 220 that is connected to the rectifier circuit 210. A DC power source, such as a battery, may be used instead of the AC power source. In this case, the rectifier circuit 210 serving as an AC/DC converter is not necessary.

The crank position angle detecting sensor 300 detects the crank position angle θ of the crank arm 124 and the detected information is inputted to the CPU 230 via the input interface circuit 250. The crank position angle θ is here defined as an angle of rotation from a reference position P shown in FIGS. 2 and 3.

The CPU 230 calculates the crank position angle θ in real time at every predetermined sampling time, based on the signals that have been inputted from the crank position angle detecting sensor 300 via the input interface circuit 250 and using a control program stored in the storage circuit 240.

Further, the storage circuit 240 also stores parameter values, such as a motor driving frequency according to the control program and the crank position angle θ that changes in real time, and the CPU 230 reads them in appropriate timing. The crank position angle θ at each sampling time and the motor driving frequency at the each crank position angle θ are stored in the storage circuit 240 as motor driving control signals shown by a waveform in FIG. 4, which will be described below in detail. The CPU 230 reads the motor driving frequency at the detected crank position angle θ from the storage circuit 240 and outputs it to the motor driving circuit 220.

An inverter circuit, which is not particularly shown in the drawings, is provided in the motor driving circuit 220 and mainly includes six transistors. The motor driving circuit 220 produces and outputs PWM signals based on the inputted motor driving frequency. The PWM signals are used to on-off control switching elements (output elements), such as the transistors that form the inverter circuit.

The output signals of the inverter circuit (motor driving signals) are outputted to input terminals u, v, w of the driving motor 111. The motor driving signals outputted to each of the input terminals u, v, w alternate like a sine wave and are 120° out of phase with each other. The cycle of the motor driving signals is responsive to the above-mentioned motor driving frequency. Specifically, the cycle of the motor driving signals to be outputted to each of the input terminals u, v, w is varied by varying the motor driving frequency. Thus, the rotational speed of the driving motor 111 is varied. The relationship between the crank position angle θ and the associated motor driving frequency will be described below in detail.

The controller 200 may be disposed within either of the housings 105, 107 of the electric hammer 101, or within the handgrip 109, or outside the electric hammer 101. Further, the storage circuit 240 may be incorporated within the CPU 230.

Basic operation of the electric hammer 101 of this embodiment will now be explained with reference to FIGS. 1 and 2. When a power cord (not shown) of the hammer 101 is connected to the AC power source 400, AC power is supplied to the rectifier circuit 210 and the driving motor 111 is driven via the motor driving circuit 220. When the crank arm 124 rotates by the rotating output of the driving motor 111, the driver 127 reciprocates within the cylinder 129. Then the striker 131 is linearly driven by utilizing the compression and expansion of air which are caused by reciprocating movement of the driver 127 within the bore 129*a* of the cylinder 129.

When the driver 127 is driven in a direction toward the hammer bit 119, air within the closed cylinder bore 129*a* is compressed. Then, when the pressure of the compressed air exceeds a predetermined value, the striker 131 is linearly driven at higher speed than the driver 127 by the action of the air spring. Thus, the striker 131 strikes the impact bolt 133 and the hammer bit 119 is linearly driven and performs a hammering operation.

On the other hand, when the driver 127 is driven in a direction away from the hammer bit 119, an expanding force acts upon the air within the cylinder bore 129*a*. Then, when the air pressure decreases below a predetermined value, the striker 131 retracts toward the driver 127 by the pressure reduction caused by the air expansion and returns to the initial position. Thus, the hammer bit 119 performs one stroke (one cycle) of the hammering operation. In the hammer 101 of this embodiment, the hammer bit 119 cyclically repeats the hammering operation of about 30 strokes per second.

The relationship between the crank position angle θ and the motor driving frequency in this embodiment and the associated movement of the driver 127 will now be explained in detail with reference to FIGS. 3 and 4. In order to reliably reduce vibration caused by fluctuations of air pressure within the cylinder bore 129*a* when the striker 131 of the hammer 101 retracts (moves away from the hammer bit 119) after completion of its striking movement, the correlation between the vibration (acceleration) caused in the hammer 101 and the crank position angle θ is analyzed using the following procedure. This analysis is performed at the stage of designing the electric hammer 101.

First, a vibration sensor is mounted on the body 103 (see FIG. 1) of the hammer 101. In this state, the hammer 101 is driven. Then, the magnitude of vibration is measured by the vibration sensor (which detects vibration of the hammer 101 as acceleration) and it is examined how the measured vibration magnitude varies with respect to the ever-changing crank position angle θ. The crank position angle θ is then determined at which vibration caused in the hammer 101 by pressure fluctuations within the bore 129*a* of the cylinder 129 becomes excessive.

In order to analyze the correlation between the vibration caused in the hammer 101 and the crank position angle θ, first, the relationship between the crank position angle θ and the relative positions of the driver 127 and the striker 131 will be explained with reference to FIG. 3(A) to FIG. 3(I). As shown in FIG. 3(A), when the crank position angle θ is "0°", the driver 127 is located at the top dead center on the side of the starting point. As shown in FIGS. 3(E) and 3(F), when the crank position angle θ is "180°", the driver 127 is located at the bottom dead center. As shown in FIGS. 3(B) to 3(E), while the crank position angle θ gradually changes from "0°" to "180°", the closed air within the cylinder bore 129*a* is compressed and the striker 131 is driven at high speed toward the hammer bit 119 and strikes the impact bolt 133 by the action of the air spring as a result of compression of the air. In this case, a certain time is required for the air pressure within the cylinder bore 129*a* to sufficiently increase by compression. Therefore, the striker 131 starts moving with a predetermined time delay after the driver 127 starts compressing the air. Further, when the striker 131 strikes the impact bolt 133, all of the kinetic energy of the striker 131 is not transferred to the impact bolt 133 and certain amount of the kinetic energy acts as repulsion in a direction away from the hammer bit 119. Due to this repulsion, the striker 131 retracts at high speed toward the driver 127 within the cylinder 129.

Figure 3:
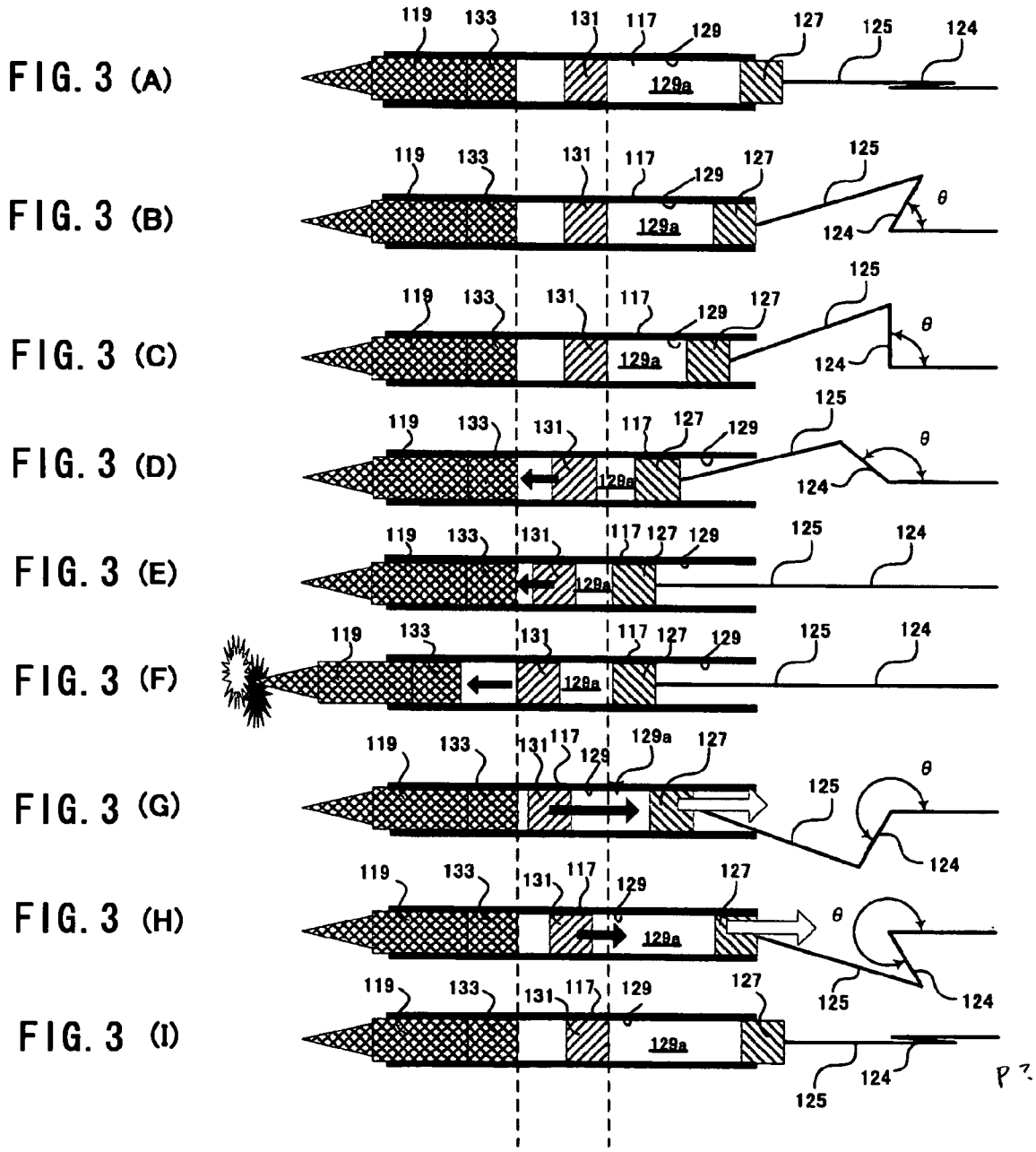
FIGS. 3(A) to 3(I) are views schematically showing the relative positions of a driver and a striker which change with the crank position angle in the electric hammer.

Further, as shown in FIGS. 3(G) and 3(H), when the crank position angle θ increases over "180°", the driver 127 moves in a direction away from the hammer bit 119 (rightward as viewed in FIG. 3). As a result, the closed air within the cylinder bore 129*a* expands. The air pressure within the cylinder bore 129*a* decreases as the air expands. This pressure reduction causes the striker 131 to retract toward the driver 127 within the cylinder 129. As a result, the driver 127 further retracts and reaches the top dead center as shown in FIG. 3(I).

It has been shown in the state shown in FIG. 3(G) or 3(H) that during the above-mentioned cyclic driving movement, the retracting speed of the striker 131 becomes excessive with respect to the retracting speed of the driver 127 due to the repulsion that the striker 131 receives in the direction away from the hammer bit 119. As a result, undesired excessive vibration may possibly be created in a rearward direction (rightward as viewed in FIG. 4) in the hammer 101 because the striker 131 retracts at higher speed and compresses the air within the cylinder bore 129*a* in spite of the fact that the driver 127 retracts in a direction of expanding the air within the cylinder bore 129*a*. As a result of the analysis, specifically in the first embodiment, when the crank position angle θ is about 250° (FIG. 3(G)), the air compressing action of the striker 131 becomes most excessive.

Therefore, in designing the hammer 101 of this embodiment, in order to reduce the vibration caused by fluctuations of the air pressure, it is arranged such that the rotational speed of the driving motor 111 or the motor driving frequency is temporarily increased before the crank position angle θ reaches "250°". In other words, in order to reduce the vibration caused in the hammer 101 due to the air compression within the cylinder bore 129*a* when the striker 131 retracts, the driving control system of the electric hammer 101 is designed such that the rotational speed of the driving motor 111 temporarily increases in response to the retracting movement of the striker 131. By thus temporarily increasing the rotational speed of the driving motor 111, the speed of the retracting movement of the driver 127 can be increased. Specifically, the relative difference between the retracting speeds of the striker 131 and the driver 127 is minimized by retracting the driver 127 at faster than normal speed. Thus, the striker 131 can be prevented from abruptly compressing the air within the cylinder bore 129*a*, so that the vibration caused in the hammer 101 due to fluctuations of the air pressure within the cylinder bore 129*a* can be reduced.

Thus, in designing the hammer 101, the time when vibration occurs due to fluctuations of the air pressure within the cylinder bore 129*a* is analyzed based on its relationship with the crank position angle θ. Through such analysis, the timing of starting vibration reduction by increasing the motor driving frequency of the driving motor 111 is determined. Further, the motor driving frequencies of the driving motor 111 which are associated with the ever-changing crank position angle θ are stored in advance in the storage circuit 240 within the controller 200. The CPU 230 then reads a motor driving frequency associated with the crank position angle θ from the storage circuit 240 and outputs it to the motor driving circuit 220.

Figure 4:
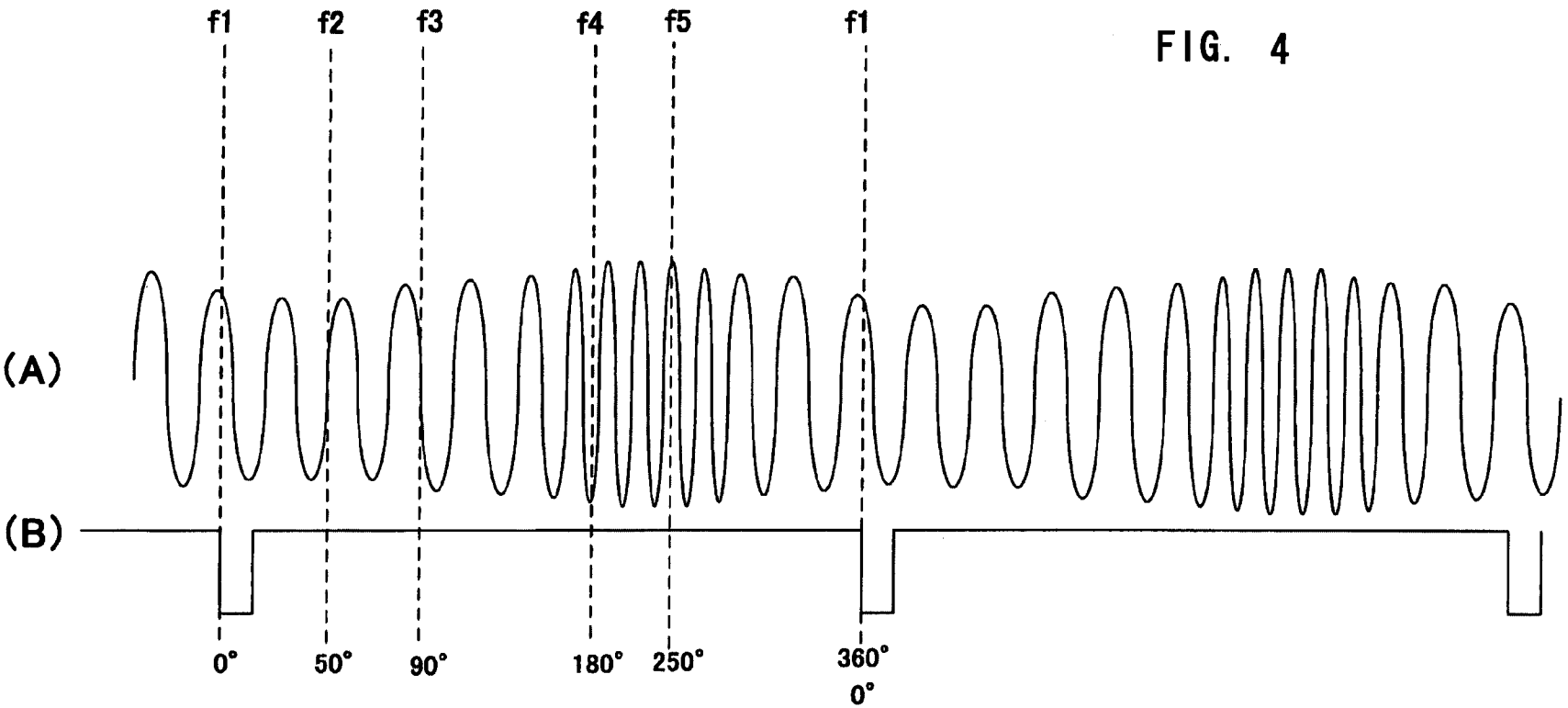
FIG. 4 is a timing chart showing an example of a motor driving control signal in relation to the crank position angle θ.

FIG. 4 is a timing chart showing an example of the output pattern of a motor driving control signal in relation to each crank position angle θ. FIG. 4(A) shows an example of the waveform of a motor driving control signal which is inputted to any one of the three input terminals of the three-phase driving motor 111. The motor driving control signal is shown as a signal which has yet to be converted into a PWM signal in the motor driving circuit 220 shown in FIG. 2. FIG. 4(B) shows an example of the waveform of a crank position angle detection signal which is outputted from the crank position angle detecting sensor 300 (see FIG. 2). The crank position angle detection signal is normally a signal of level "H" (High) and outputs a pulse of level "L" (Low) each time the eccentric shaft 123 passes the point at which the crank position angle is 0°. In response to this level shift, the CPU 230 determines the crank position angle "0°" and the crank position angle θ changing in real time.

The motor driving frequency is designated by f1 when the crank position angle is "0°" in FIG. 4. At this time, the driver 127, the striker 131 and the hammer bit 119 are in the state shown in FIG. 3(A).

The motor driving frequency is designated by f2 when the crank position angle is "50°" in FIG. 4. At this time, the driver 127, the striker 131 and the hammer bit 119 are in the state shown in FIG. 3(B).

The motor driving frequency is designated by f3 when the crank position angle is "90°" in FIG. 4. At this time, the driver 127, the striker 131 and the hammer bit 119 are in the state shown in FIG. 3(C).

The motor driving frequency is designated by f4 when the crank position angle is "180°" in FIG. 4. At this time, the driver 127, the striker 131 and the hammer bit 119 are in the state shown in FIGS. 3(E) and 3(F).

The motor driving frequency is designated by f5 when the crank position angle is "250°" in FIG. 4. At this time, the driver 127, the striker 131 and the hammer bit 119 are in the state shown in FIG. 3(G).

The motor driving frequency is designated by f1 when the crank position angle is "360°" in FIG. 4, as in the case of the crank position angle of "0°". At this time, the driver 127, the striker 131 and the hammer bit 119 are in the state shown in FIG. 3(I). Thus, in the live electric hammer 101, the above-mentioned series of movement is sequentially performed in each cycle (in each turn of the driving gear 122).

As mentioned above, the striker 131 strikes the hammer bit 119 and retracts at higher speed than the driver 127 by the action of the air spring. As a result, the closed air within the cylinder bore 129*a* is strongly compressed by the striker 131. Particularly, it has been shown that the biggest vibration is caused in the hammer 101 when the crank position angle θ is about 250°. In this embodiment, in order to reduce vibration caused by such pressure fluctuations, when the crank position angle is in the range of about 230° to 300°, the motor driving frequency (see FIG. 4) is increased from f4 to f5, so that the rotational speed of the driving motor is increased by a predetermined amount. As a result, as shown by hollow arrow in FIGS. 3(G) and 3(H), the driver 127 retracts at faster than normal speed. Therefore, the retracting speed of the striker 131 is prevented from becoming excessive with respect to the retracting speed of the driver 127. Thus, the abrupt action by the striker 131 compressing the air within the cylinder bore 129*a* can be alleviated. As a result, vibration caused in the hammer 101 can be reduced.

Further, in this embodiment, the retracting speed of the driver 127 can be varied simply by varying the motor driving frequency of the driving motor 111. Therefore, it is not necessary to additionally provide a machine element for reducing vibration, so that structural complication can be avoided.

Typically, in many electric hammers, the number of times the hammer bit strikes per unit time is predetermined. In other words, the electric hammer generally has predetermined cycle time for its operation. According to the electric hammer 101, it is programmed such that the hammer bit 119 strikes 30 times per second. However, such periodicity of the hammer 101 may vary because the above-mentioned vibration reducing mechanism is designed to reduce vibration by varying the motor driving frequency of the driving motor 111. In other words, such mechanism may adversely affect the number of times the hammer bit strikes per unit time.

Therefore, in this embodiment, in order to prevent the hammer 101 from varying in periodicity by vibration reduction, the advancing speed of the driver 127 (the speed of moving toward the striker 131) is decreased by the amount of increase of the retracting speed of the driver 127, so that the periodicity can be maintained. Thus, the vibration can be reduced without affecting the originally programmed periodic striking movement of the hammer 101.

Specifically, in this embodiment, the frequency of the motor control signals (see FIG. 4(A)) varies stepwise with the crank position angle θ. For example, the frequency is "f1" in the crank position angle range of about 0° to 10°, "f2" in the range of about 10° to 80°, "f3" in the range of about 80° to 150°, "f4" in the range of about 150° to 230°, "f5" in the range of about 230° to 300°, and "f1" in the range of about 300° to 360° (0°). Thus, the motor driving frequency varies stepwise at about the same intervals. In order to ensure the above-mentioned periodicity, the increased frequency "f5" in the crank position angle range of about 230° to 300° is appropriately compensated for by decreasing the frequency "f2" in the crank position angle range of about 10° to 80°.

For example, in this embodiment, it is programmed such that the maximum frequency is "f5" and the minimum frequency is "f2" in one cycle (one turn), with the following relationship of magnitude among the frequencies:

$$f1>f2<f3<f4<f5>f1$$

Further, in this embodiment, each frequency is programmed to meet the following:

$$f1\cdot t1+f2\cdot t2+f3\cdot t3+f4\cdot t4+f5\cdot t5=fa(t1+t2+t3+t4+t5)$$

where "fa" is the motor driving frequency which is not controlled to vary in one cycle, and "t1", "t2", "t3", "t4" and "t5" are periods of time for which the frequency is "f1", "f2", "f3", "f4" and "f5", respectively, in one turn of the crank shaft. Here, the frequency "fa" can be calculated as a mean value of the motor driving frequency that is stored in the storage circuit 240 and varies every moment with the crank position angle θ. Further, the time t1 to t5 can be calculated from the time required for the crank arm 124 to rotate one turn, which time can be detected by the output signals of the crank position angle detecting sensor 300, and the crank position angle θ that varies in real time. Thus, the rotational speed of the driving motor 111 can be averaged in one cycle. As a result, the periodicity of the electric hammer 101 or the number of strokes of the hammer bit 119 per unit time (or the average time required for the hammer bit 119 to perform one stroke) can be prevented from varying.

Besides the above, the compensation for the above motor driving frequency may not be necessarily performed within one cycle in which the driver 127 returns from the top dead center to the bottom dead center, but may be performed within several cycles in such a manner as not to affect the overall driving conditions of the hammer 101. Further, in the above embodiment, the motor driving frequency which increases when the driver 127 moves from the bottom dead center near the striker 131 to the top dead center remote from the striker 131 is compensated for by decreasing the motor driving frequency by the amount of increase when the driver 127 moves from the top dead center to the bottom dead center. Instead, it may be constructed such that such increase of the motor driving frequency is compensated for by decreasing it in a predetermined period while the driver 127 moves from the bottom dead center to the top dead center. For example, the motor driving frequency may be decreased when the crank position angle is in the range of about 300° to 360°.

Further, although in the above embodiment, the motor driving frequency varies stepwise, it may be constructed such that the motor driving frequency varies continuously with time. With such construction, the rotational speed of the driving motor 111 varies in better response to the changes of the motor driving frequency. Also in this case, it is preferable that the motor driving frequency that has been increased by a predetermined amount is compensated for during one stroke of the driver 127 (one turn of the driving gear 122). Further, control of fluctuations of the motor driving frequency may be performed several times in one cycle.

Further, it may be programmed such that the motor driving frequency starts increasing before the crank position angle θ reaches 250°, for example, when the crank position angle θ of 180° (bottom dead center) is detected, or immediately after the crank position angle θ of 180° (bottom dead center) is detected. In either case, any timing can be appropriately programmed in which vibration caused by fluctuations of air pressure can be reduced by temporarily increasing the rotational speed of the driving motor 111.

Although this embodiment has been described with respect to the electric hammer 101 as an example of the power tool of the present invention, the invention can also be applied to various power tools which drive a tool bit by utilizing compressed air.

The representative embodiment adopts three-phase motor as the driving motor 111. Because the three-phase motor is driven by using an inverter circuit, the carrier frequency at which PWM signals are produced can be increased sufficiently. Typically, the carrier frequency can be set to several to twenty kilo hertz. Therefore, the rotational speed of the motor can be precisely controlled, so that the motor is highly practical. For example, when the crank arm 124 rotates 30 turns per second and the carrier frequency is 15 kHz, control of the motor driving frequency can be performed 500 times in one turn of the crank arm 124.

Further, in this embodiment, undesired air compression which causes vibration in the hammer 101 has been described as being caused by repulsion that the striker 131 receives in the direction away from the hammer bit 119. However, such air compression may also be caused by other factors. For example, when the driver 127 retracts away from the hammer bit 119, air within the cylinder bore 129*a* expands and the striker 131 starts retracting at high speed toward the driver 127, which may also become a cause of undesired air compression.

Second Representative Embodiment

Second representative embodiment is now described in detail in reference to FIGS. 5 to 13. As to the feature of the second representative embodiment that is substantially identical to the feature of the first representative embodiment, same reference number is used and detailed explanation is abbreviated for the sake of convenience. In the electric hammer 201 according to the second representative embodiment, a vibration sensor 500 for detecting acceleration (detecting information about vibration) caused in the region of the handgrip 109 is disposed within the body 103. The acceleration caused in the region of the handgrip 109 is a feature that corresponds to the "vibration information" in the present invention.

Figure 6:
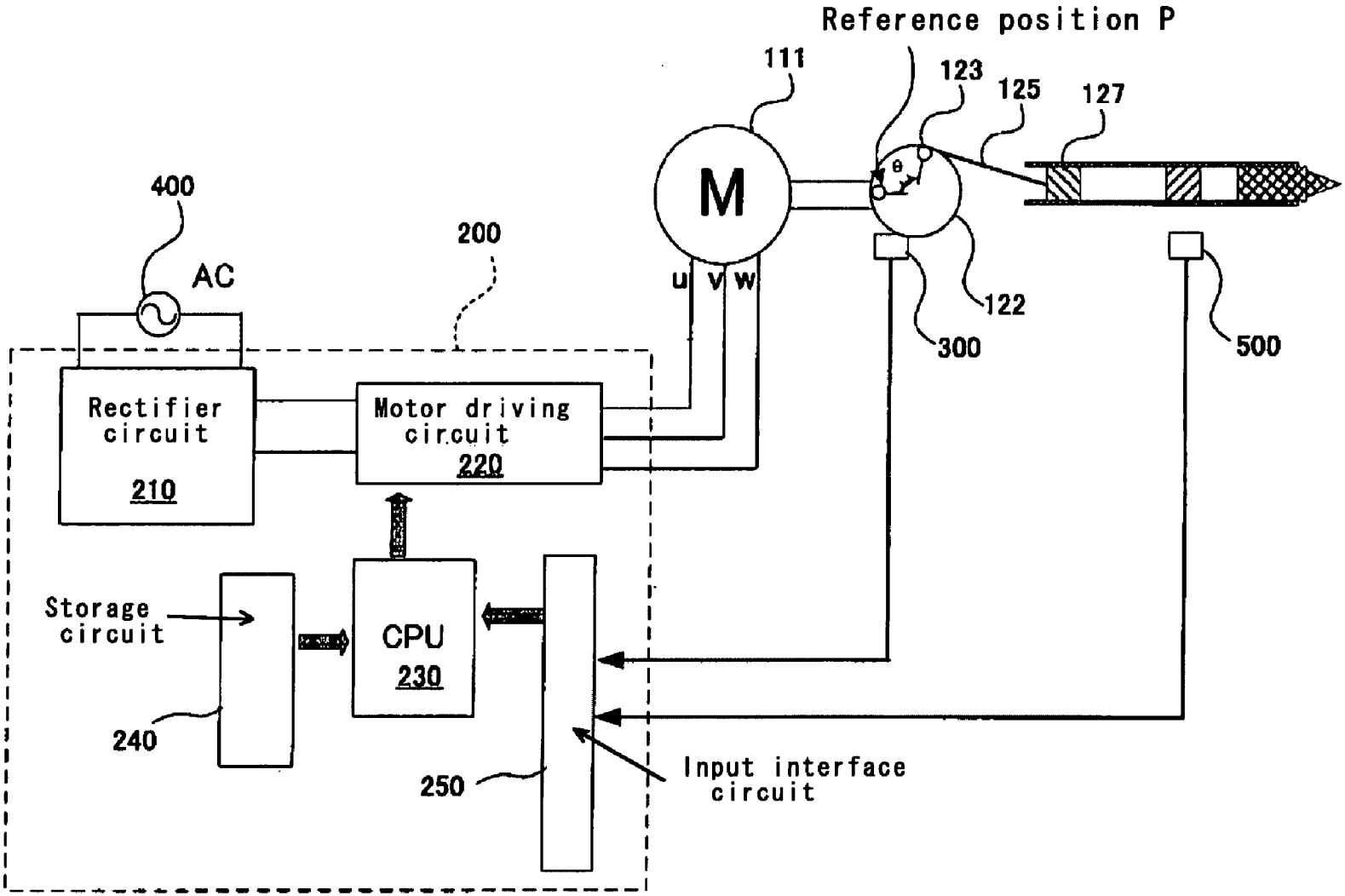
FIG. 6 is a block diagram of a control system of the electric hammer.

Further, in the electric hammer 201, the vibration sensor 500 detects acceleration caused in the body 103 of the hammer 201, and the detected information is inputted to the CPU 230 via the input interface circuit 250 as shown in FIG. 6. The vibration sensor 500 and the acceleration in the body 103 will be described below in more detail.

The storage circuit 240 as shown in FIG. 6 stores parameter values such as the amount of change Δf of the variation ΔF of the motor driving frequency F for determining a motor driving frequency F according to the control program, the crank position angle θ, and the magnitude and direction of the vibration caused in the body 103. The CPU 230 calculates the motor driving frequency F according to the calculated crank position angle θ and the magnitude and direction of the vibration caused in the body 103 by using the parameters read from the storage circuit 240 and outputs it to the motor driving circuit 220.

The relationship between the crank position angle θ and the motor driving frequency F and the associated movement of the driver 127 will now be explained in detail with reference to FIGS. 7 to 13. When the electric hammer 201 performs a hammering operation on a work-piece, the correlation between the vibration (acceleration) caused in the hammer 201 and the crank position angle θ is analyzed in real time in order to reduce vibration caused by fluctuations of air pressure within the cylinder bore 129*a* when the striker 131 of the hammer 201 retracts (moves away from the hammer bit 119) after completion of its striking movement. The hammering operation is performed while the motor driving frequency F is appropriately adjusted and updated at each crank position angle θ based on the results of the analysis.

Figure 8:
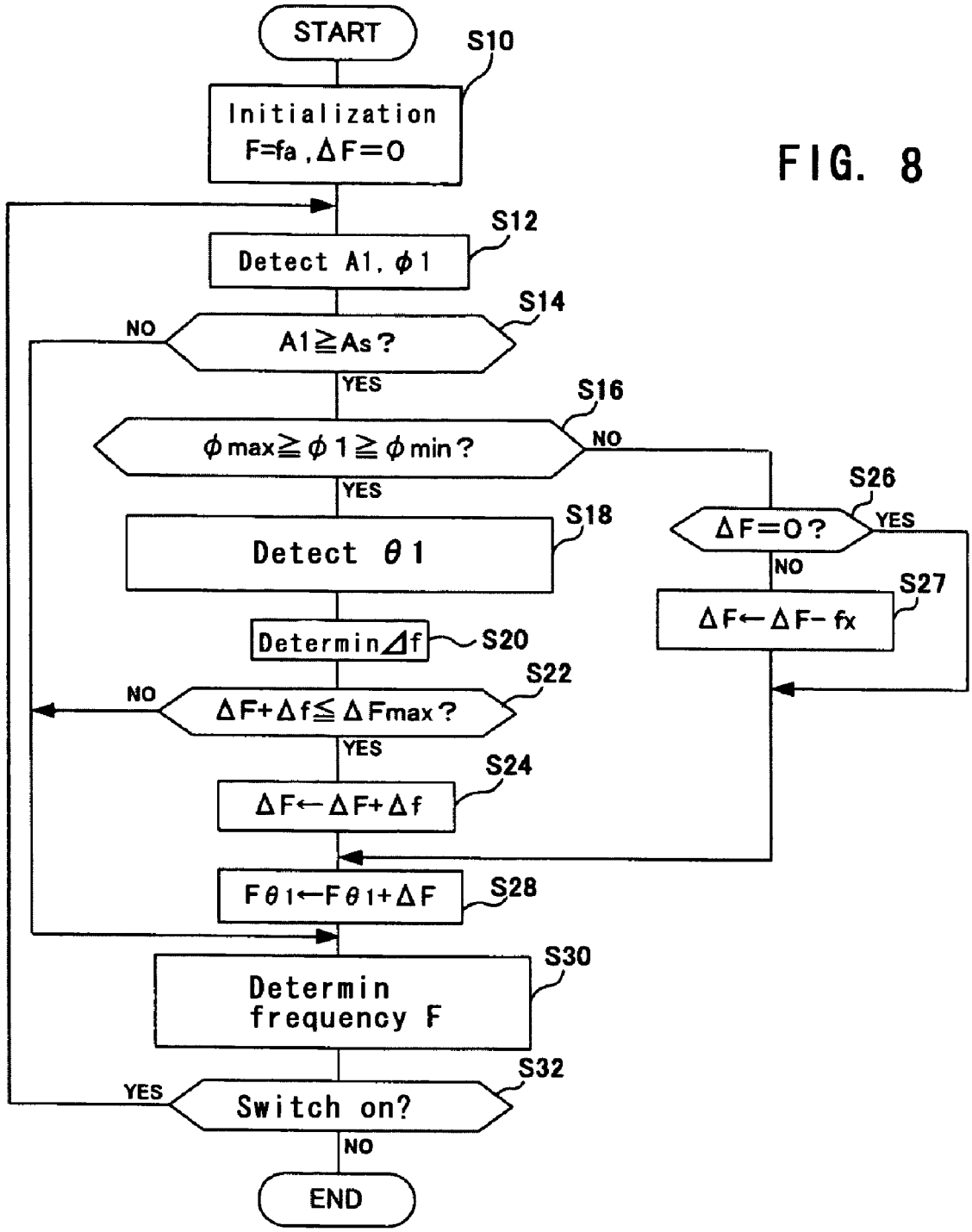
FIG. 8 is a flow chart showing a process of determining the motor driving frequency, which is executed by a CPU of a controller.
Figures 9, 10:
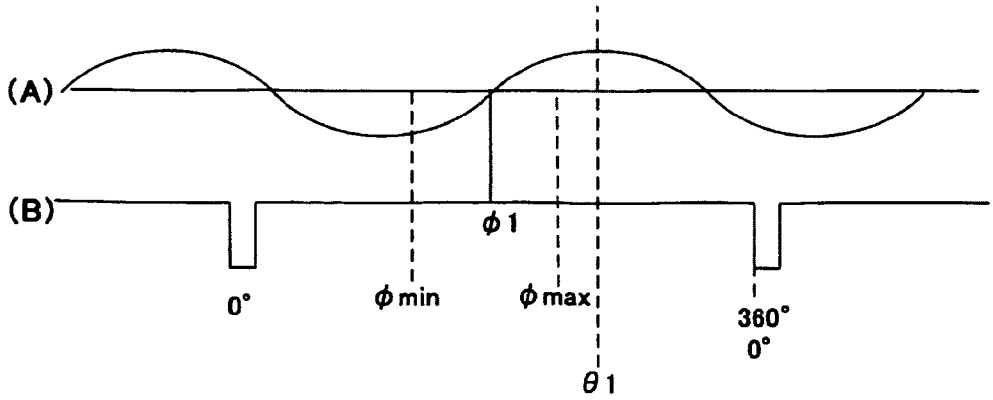
FIG. 9 shows an example of a map used for determining the amount of change Δf in step S20 of the flow chart of FIG. 4.
FIG. 10 is a timing chart showing an example of a vibration fundamental in relation to the crank position angle θ.
Figure 11:
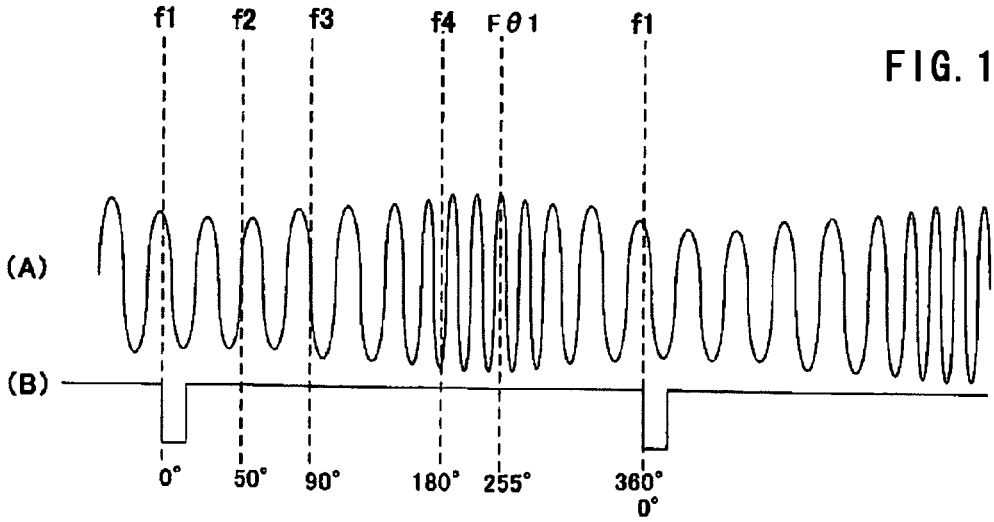
FIG. 11 is a timing chart showing an example of a motor driving control signal in relation to the crank position angle θ.
Figure 12:
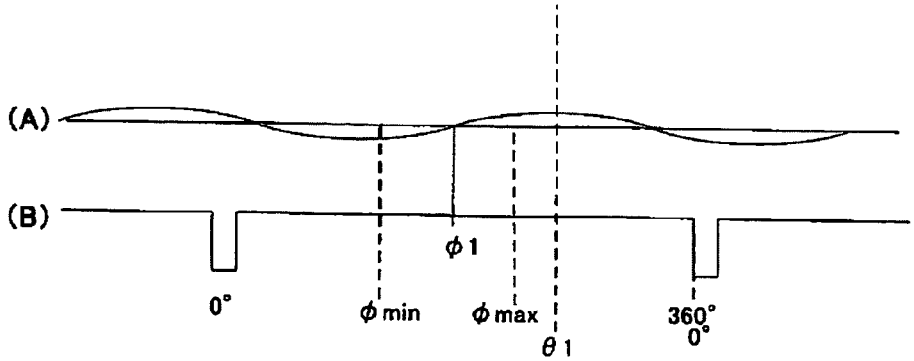
FIG. 12 is a timing chart showing an example of a vibration fundamental of which amplitude value is decreased due to vibration reduction.
Figure 13:
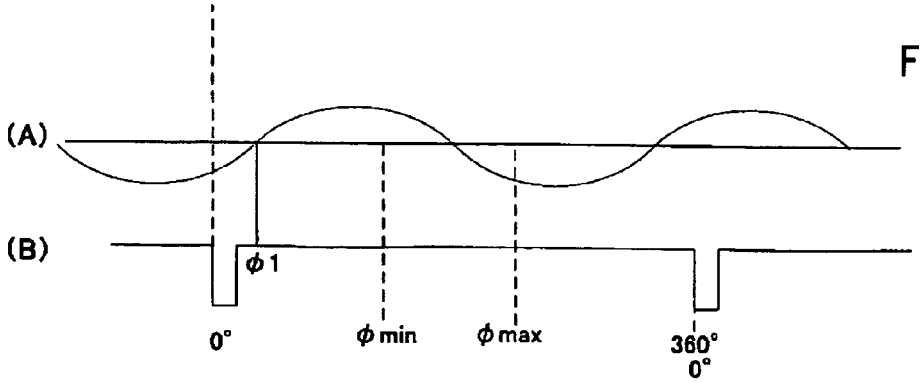
FIG. 13 is a timing chart showing an example of the vibration fundamental inverted due to excessive vibration reduction.

FIG. 7(A) to 7(I) schematically shows the relative positions of the driver 127 and the striker 131 which change with the crank position angle θ in the electric hammer 101. FIG. 8 is a flow chart showing a process of controlling the motor driving frequency F which is executed by the CPU 230 of the controller 200. FIG. 9 shows a map used in the process of FIG. 8. FIG. 10 shows an example of a fundamental of vibration caused in the body 103, which is related to the crank position angle θ. FIG. 11 shows an example of a motor driving control signal which is related to the crank position angle θ during vibration reduction in this embodiment. FIG. 12 shows an example of the vibration fundamental shown in FIG. 10, but having amplitude decreased for the purpose of vibration reduction. FIG. 13 shows an example of the vibration fundamental which is inverted due to excessive vibration reduction.

The correlation between the vibration caused in the hammer 101 and the crank position angle θ will be explained first. To this end, the relationship between the crank position angle θ and the relative positions of the driver 127 and the striker 131 in one cycle in which the electric hammer 101 performs a hammering operation on a work-piece once (in one stroke of the hammer bit 119) will be explained with reference to FIGS. 7(A) to 7(I).

As shown in FIG. 7(A), when the crank position angle θ is "0°", the driver 127 is located at the top dead center on the side of the starting point. As shown in FIGS. 7(E) and 7(F), when the crank position angle θ is "180°", the driver 127 is located at the bottom dead center. As shown in FIGS. 7(B) to 7(E), while the crank position angle θ gradually changes from "0°" to "180°", the closed air within the cylinder bore 129*a* is compressed, and the striker 131 is driven at high speed toward the hammer bit 119 and strikes the impact bolt 133 by the action of the air spring as a result of compression of the air. In this case, a certain time is required for the air pressure within the cylinder bore 129*a* to sufficiently increase by such compression. Therefore, the striker 131 starts moving with a predetermined time delay after the driver 127 starts compressing the air. Further, when the striker 131 strikes the impact bolt 133, all of the kinetic energy of the striker 131 is not transferred to the impact bolt 133. Part of the kinetic energy acts as repulsion in a direction away from the hammer bit 119. Due to this repulsion, the striker 131 retracts toward the driver 127 within the cylinder 129 at faster than normal speed (the normal speed is the speed at which the striker 131 retracts due to pressure reduction caused by air expansion within the cylinder bore 129*a* when the driver is driven in a direction away from the hammer bit 119).

Figure 7:
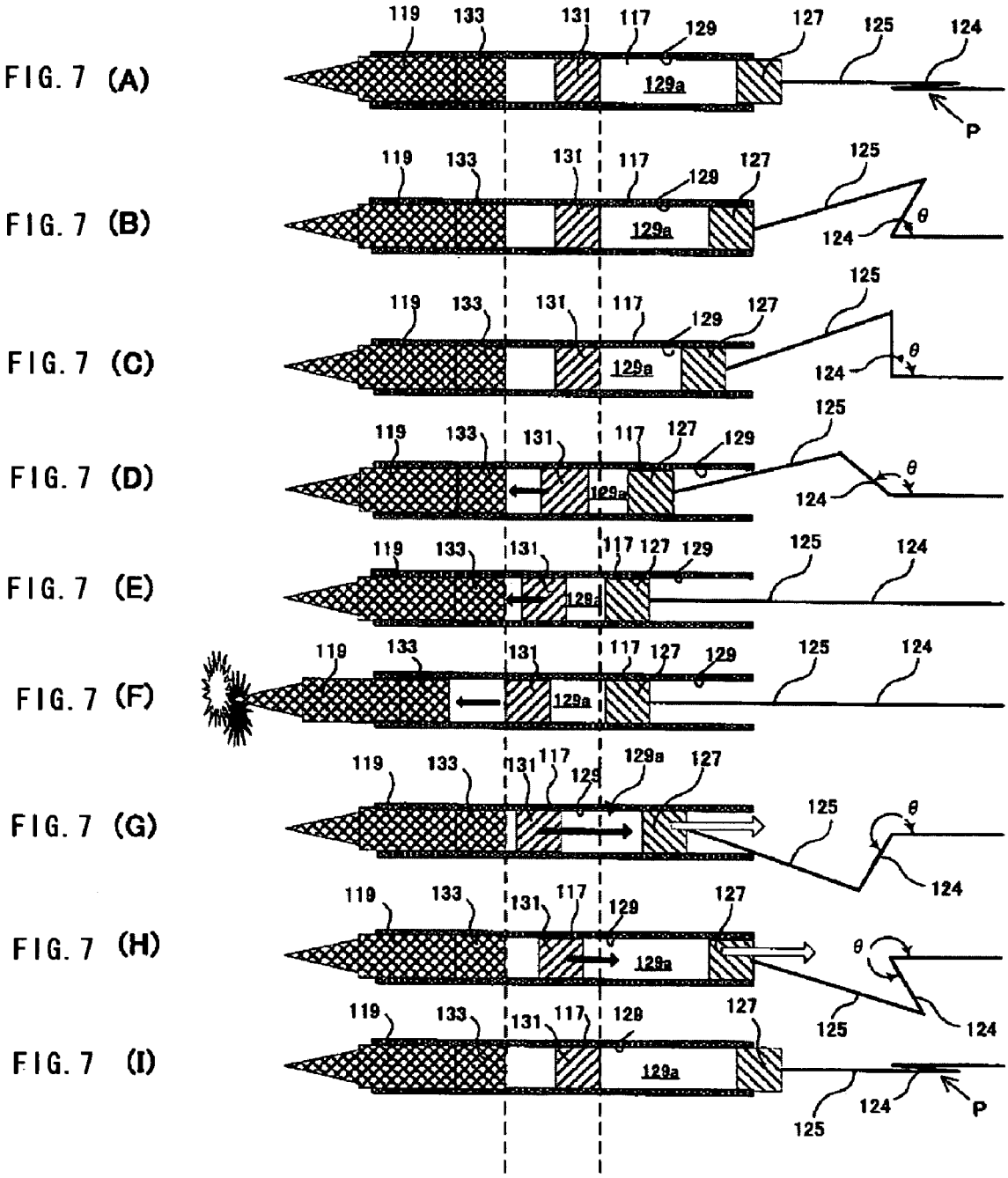
FIGS. 7(A) to 7(I) are views schematically showing relative positions of a driver and a striker which change with the crank position angle in the electric hammer.

Further, as shown in FIGS. 7(G) and 7(H), when the crank position angle θ increases over "180°", the driver 127 moves in a direction away from the hammer bit 119 (rightward as viewed in FIG. 7). As a result, the closed air within the cylinder bore 129*a* expands. The air pressure within the cylinder bore 129*a* decreases as the air expands. This pressure reduction causes the striker 131 to retract toward the driver 127 within the cylinder 129. As a result, the driver 127 further retracts and reaches the top dead center as shown in FIG. 7(I).

In this embodiment, in the state shown in FIG. 7(G) or 7(H) during the above-mentioned cyclic driving movement, the retracting speed of the striker 131 becomes excessive with respect to the retracting speed of the driver 127 due to the repulsion the striker 131 receives in the direction away from the hammer bit 119. This repulsion is greater particularly when the work-piece is made of a harder material, such as a rock, and thus the retracting speed of the striker 131 becomes more excessive. As a result, undesired excessive vibration may possibly be created in a rearward direction (rightward as viewed in FIG. 4) in the hammer 201 because the striker 131 retracts at higher speed and compresses the air within the cylinder bore 129*a* in spite of the fact that the driver 127 retracts in a direction of expanding the air within the cylinder bore 129*a*. In this representative embodiment, when the crank position angle θ is about 250° (FIG. 7(G)), the air compression within the cylinder bore 129*a* becomes excessive and undesired vibration reaches its peak value. However, the actual peak value of such vibration may often vary around at the crank position angle of about 250° according to the hardness of the work-piece or other factors. Therefore, in the electric hammer 201 of this embodiment, a crank position angle θ1 at which vibration reaches its peak value is detected, and the rotational speed of the driving motor 111 at this crank position angle θ1 is increased according to the magnitude of vibration. Thus, the driver 127 is caused to retract at faster than normal speed, so that the air compressing action can be alleviated.

Therefore, in the electric hammer 101, when it is determined that the vibration caused in the hammer 101 meets the first condition that it is of a magnitude greater than a predetermined value and the second condition that vibration is created in a rearward direction in the hammer 101, in order to reduce the vibration, the motor driving frequency F is increased at the crank position angle θ1 so that the rotational speed of the driving motor 111 is increased. To this end, in the electric hammer 101, the magnitude and direction of the vibration caused in the body 103 are detected in real time based on the acceleration that is caused in the body 103 and detected by the vibration sensor 500. Further, the crank position angle θ is detected in real time by the crank position angle detecting sensor 300.

In this embodiment, the first condition is set up that the vibration peak value is over 3 $m/s^2$ (the amplitude of the vibration fundamental exceeds the threshold value "As"). Further, the second condition is set up that the phase angle of the vibration fundamental is in the range of 120° to 180° (between the lower limit ϕ min and the upper limit ϕ max of the normal range of the phase angle) with respect to the crank position angle of 0°. It is then determined that rearward vibration is caused in the electric hammer 101 during the retracting movement of the striker 131 when the crank position angle is 180° or larger (in other words, forward vibration is not caused in the electric hammer 101 even in the period during which the vibration fundamental is inverted due to excessive control, which will be described below, and the striker retracts).

It is programmed such that when the above-mentioned first and the second conditions are met, the rotational speed of the driving motor 111 or the motor driving frequency F is temporarily increased to a motor driving frequency Fθ1 according to the magnitude of vibration before the crank position angle θ reaches the crank position angle θ1 at which excessive vibration is caused. In other words, in order to reduce the vibration caused in the hammer 101 due to the air compression within the cylinder bore 129*a* when the striker 131retracts, the motor driving frequency F is set such that the rotational speed of the driving motor 111 temporarily increases according to the magnitude of vibration when the striker 131 retracts. By temporarily increasing the rotational speed of the driving motor 111, the speed of the retracting movement of the driver 127 can be temporarily increased. Specifically, the relative difference between the retracting speeds of the striker 131 and the driver 127 is minimized by causing the driver 127 to retract temporarily at faster than normal speed. Thus, the striker 131 can be prevented from abruptly compressing the air within the cylinder bore 129*a*, so that the vibration caused in the hammer 101 due to fluctuations of the air pressure within the cylinder bore 129*a* can be reduced. Further, in the electric hammer 201, the increase of the motor driving frequency is compensated for by decreasing it by the amount of increase during the other period within the cycle, so that the periodicity of the electric hammer 101 can be prevented from varying.

To this end, the CPU 230 of the controller 200 in the electric hammer 201 executes a program for determining the motor driving frequency F, which is shown in the flow chart of FIG. 8, in order to perform vibration reduction appropriate to the magnitude of the vibration caused by fluctuations of air pressure within the cylinder bore 129*a*.

When the electric hammer 201 is driven, first, in step S10, the CPU 230 initializes the motor driving frequency F. Here, the motor driving frequency F is "fa" in a case where it is not caused to vary during one cycle (vibration reduction is not performed). The amount by which the motor driving frequency F is caused to vary when rearward vibration detected by the detection sensor 500 reaches its peak value in one cycle is a frequency variation ΔF. In step S10, initialization is performed such that the motor driving frequency F="fa" and the variation ΔF="0". Then the CPU 230 goes to step S12.

In step S12, the CPU 230 obtains information (vibration information) about acceleration which is being caused in the body 103, via the vibration sensor 500. Specifically, the CPU 230 detects indexes relating to the magnitude and direction of the vibration, based on the vibration information in one cycle which has been detected by the vibration sensor 500 and inputted via the input interface circuit 250. For example, the vibration fundamental (see FIG. 10(A)) in one cycle is Fourier converted and the amplitude value "A1" of the converted vibration fundamental is detected as an index relating to the magnitude of the vibration. Further, a phase angle "ϕ1" (phase difference) with respect to a 0° crank position angle of the vibration fundamental (see FIG. 10(B)) is detected as an index relating to the direction of the vibration. Then, the CPU 230 goes to step S14.

In steps S14 and S16, the CPU 230 determines whether vibration reduction control is necessary. In step S14, it is determined whether the above-mentioned first condition is met, and in step S16, it is determined whether the second condition is met. First, in step S14, it is determined whether the amplitude value "A1" of the vibration fundamental detected in step S12 is greater than the threshold value "As" of the amplitude value. When the amplitude value "A1" is equal to or greater than the threshold value of the amplitude value (YES in step S14), the CPU 230 goes to step S16. In this case, the vibration caused in the body 103 is so large as to need vibration reduction. On the other hand, when the amplitude value A1 is equal to or less than the threshold value of the amplitude value (NO in step S14), the CPU 230 goes to step S30. In this case, the vibration caused in the body 103 is not so large as to need vibration reduction control.

In step S16, it is determined whether the phase angle "ϕ1" of the vibration fundamental detected in S12 is equal to or greater than the predetermined minimum phase angle "ϕ min" of the vibration fundamental and equal to or less than the maximum phase angle "ϕ max" of the vibration fundamental. When, as shown in FIG. 10(A), the phase angle "ϕ1" of the vibration fundamental is equal to or greater than the minimum phase angle "ϕ min" of the vibration fundamental and equal to or less than the maximum phase angle "ϕ max" of the vibration fundamental (YES in step S16), the CPU 230 goes to step S18. In this case, it is determined that the vibration fundamental is not inverted (vibration is caused in the rearward direction in the hammer 201 when the crank position angle exceeds 180°) and thus excessive vibration reduction is not taking place.

On the other hand, when , as shown in FIG. 13(A), the phase angle "ϕ1" of the vibration fundamental is less than the minimum phase angle "ϕ min" of the vibration fundamental, or greater than the maximum phase angle "ϕ max" of the vibration fundamental (NO in step S16), the CPU 230 goes to step S26. In this case, it is determined that the vibration fundamental is inverted (vibration is caused in the forward direction in the hammer 101 when the crank position angle exceeds 180°) and thus there is a possibility of excessive vibration reduction.

Figure 5:
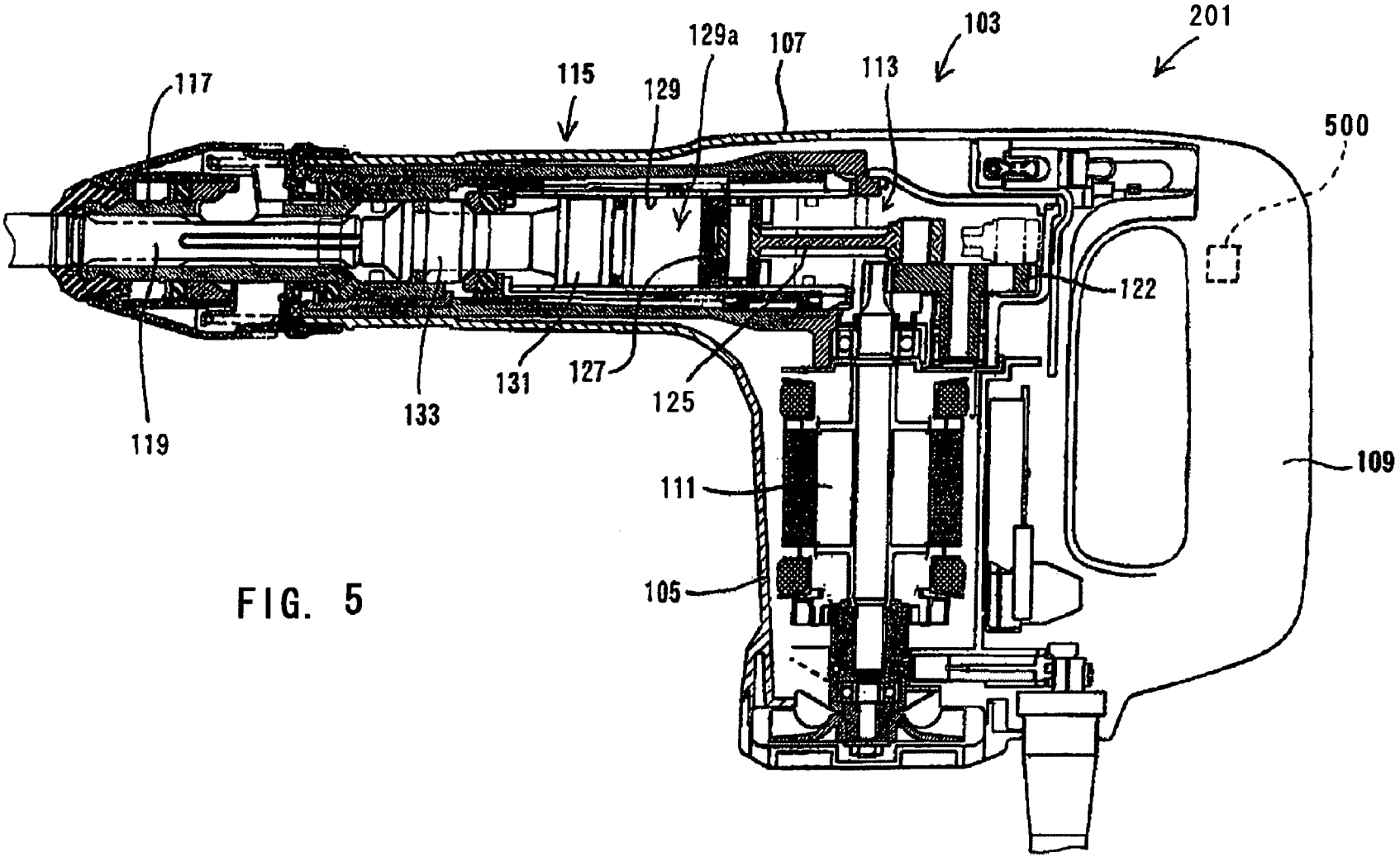
FIG. 5 is a sectional view schematically showing an entire electric hammer according to the second representative embodiment of the invention.

In step S18, the crank position angle "θ1" at which the vibration fundamental reaches the maximum value (the peak value in the direction toward the user) is detected (see FIG. 5). Typically, the crank position angle "θ1" is about 250°. In this embodiment, it is assumed that the detected crank position angle "θ1" is 255°. The CPU 230 can sample information detected by the crank position angle detecting sensor 300 and detect the crank position angle "θ" in real time. The CPU 230 then goes to step S20.

In step S20, the CPU 230 determines the amount of change "Δf" of the variation "ΔF" of the motor driving frequency "F". Here, the value of the amount of change "Δf" is stored in advance in the storage circuit 240 as a map as shown in FIG. 9. As shown in FIG. 9, when the amplitude value "A1" is greater than the threshold value As of the amplitude value and equal to or less than a set value Ax, "fx" is selected as the amount of change "Δf". When the amplitude value A1 is greater than the set value Ax and equal to or less than a set value "Ay", "fy" is selected as the amount of change "Δf". Further, when the amplitude value "A1" is greater than the set value "Ay", "fz" is selected as the amount of change "Δf". Preferably, the amount of change "Δf" is set such that "fx<fy<fz". Thus, when the amplitude value "A1" of the vibration fundamental is greater, a greater value is selected as the amount of change "Δf". The CPU 230 then goes to step S22.

In step S22, it is determined whether the variation "ΔF" of the motor driving frequency "F" at the crank position angle "θ1" (the motor driving frequency F is "F+ΔF" at the crank position angle "θ1") plus the amount of change "Δf" which has been selected in step 20 is equal to or less than the upper limit "ΔFmax" of the variation "ΔF" of the motor driving frequency "F" (according to the motor specifications). When the variation "ΔF" plus the amount of change "Δf" selected in step 20 is greater than the upper limit "ΔFmax" (NO in step S22), it is selected that the amount of change "Δf" is not added to the variation "ΔF" of the motor driving frequency "F", because the present variation "ΔF" of the motor driving frequency at the crank position angle "θ1" plus the amount of change "Δf" selected in step 20 will exceed the upper limit "ΔFmax". Then, the CPU 230 goes to step S30. On the other hand, when the variation "ΔF" of the motor driving frequency plus the amount of change "Δf" selected in step 20 is equal to or less than the upper limit "ΔFmax" (YES in step S22), the CPU 230 goes to step S24.

In step S24, the CPU 230 updates the value of the variation "ΔF" by adding the amount of change "Δf" selected in step S20. The CPU 230 then goes to step S28.

On the other hand, in step 26, the CPU 230 determines whether the variation "ΔF" is zero or not. When the variation "ΔF" is zero (YES in step S26), the CPU 230 goes to step S28. In this case, the CPU is not executing vibration reduction at the moment, and the vibration of the inverted vibration fundamental detected in step S16 is not caused by excessive vibration reduction. On the other hand, when the variation "ΔF" is not zero (NO in step S26), the CPU 230 goes to step S27. In step 27, the CPU 230 executes control of preventing an excessive vibration reduction.

Now, the state of excessive vibration reduction in the electric hammer 201 will be explained with reference to FIGS. 7(G) and 7(H). In the state shown in FIGS. 7(G) and 7(H), the repulsion that the striker 131 receives in the direction away from the hammer bit 119 varies in magnitude depending on the presence or absence of the work-piece to be in contact with the hammer bit 119, or the hardness of the work-piece.

When the work-piece has a low hardness, or when the work-piece is not in contact with the hammer bit 119, it is not necessary to perform vibration reduction. Otherwise, increase of the motor driving frequency F may possibly cause a problem. For example, the driver 127 is caused to retract at too high speed in a direction of expanding the air within the cylinder bore 129*a*, so that undesired expansion of the air within the cylinder bore 129*a* occurs. As a result, undesired vibration may be caused in the forward direction (in the leftward direction as viewed in FIG. 3) of the electric hammer 101.

Therefore, in step S27, the CPU 230 updates the value of the variation "ΔF" by subtracting the amount of change "fx"

from the variation "ΔF" (the variation "ΔF" is decreased). The CPU 230 then goes to step S28.

In step S28, the CPU 230 updates the motor driving frequency "Fθ1" at the crank position angle "θ1" by adding the variation "ΔF" to the frequency "Fθ1". The CPU 230 then goes to step S30.

In step S30, the motor driving frequency "F" at each crank position angle "θ" is determined. In this embodiment, vibration reduction has been performed in step S28 by increasing the motor driving frequency "Fθ1", by the variation "ΔF", at the crank position angle "θ1" at which the amplitude value of the vibration fundamental is "A1". Therefore, in order to prevent the periodicity of the electric hammer 101 from varying, it is programmed such that the variation "ΔF" is decreased somewhere in one cycle.

To this end, the motor driving frequency F is programmed to vary stepwise at about the same intervals. Specifically, as shown in FIG. 11, the frequency is "f1" in the range of crank position angles "θ" of about 0° to 10°, "f2" in the range of about 10° to 80°, "f3" in the range of about 80° to 150°, "f4" in the range of about 150° to 230°, the motor driving frequency "Fθ1", which has been determined in step S28, in the range of crank position angles "θ" of about 230° to 300° in which the crank position angle θ1 falls as having been detected as 255° in step S18 in this embodiment, and "f1" in the range of about 300° to 360° (0°). In order to ensure the above-mentioned periodicity, the increase of the motor driving frequency "Fθ1" in the crank position angle range of about 230° to 300° is appropriately compensated for by decreasing the frequency "f2" in the crank position angle range of about 10° to 80°.

In this embodiment, it is programmed such that the maximum frequency is the motor driving frequency "Fθ1" and the minimum frequency is "f2" in one cycle, with the following relationship of magnitude among the frequencies:

$$\text{“}f1>f2<f3<f4<F\theta1>f1\text{”}$$

Further, in this embodiment, each frequency is programmed to meet the following equation:

$$\text{“}f1\cdot t1+f2\cdot t2+f3\cdot t3+f4\cdot t4+(\text{the motor driving frequency } F\theta1)\cdot t5=fa(t1+t2+t3+t4+t5)\text{”}$$

where "fa" is the motor driving frequency in a case where it is not controlled to vary in one cycle, and "t1", "t2", "t3", "t4" and "t5" are periods of time for which the frequency is "f1", "f2", "f3", "f4" and the motor driving frequency "Fθ1", respectively, in one cycle.

Here, the frequency "fa" can be calculated as a mean value of the motor driving frequency "F" stored in the storage circuit 240 and varies every moment with the crank position angle "θ". Further, the time "t1" to "t5" can be calculated from the time required for the crank arm 124 to rotate one turn, which time can be detected by the output signals of the crank position angle detecting sensor 300, and the crank position angle θ that varies in real time. Thus, the rotational speed of the driving motor 111 can be averaged in one cycle. As a result, the periodicity of the electric hammer 101 or the number of strokes of the hammer bit 119 per unit time (or the average time required for the hammer bit 119 to perform one stroke) is prevented from varying. Thus, the motor driving frequency "F" at each crank position angle "θ" is determined and then, the CPU 230 goes to step S32.

In step S32, it is determined whether a switch (not shown) of the electric hammer 201 is on or not. When it is on (YES in step S32), the CPU 230 goes to step S12. When it is not on (NO in step S32), the CPU 230 completes the program.

FIG. 11 shows an example of the output pattern of a motor driving control signal in relation to the crank position angle "θ". The motor driving control signal is outputted by determining the motor driving frequency "F" when vibration having a vibration fundamental as shown in FIG. 10(A) is caused in the body 103. FIG. 11(A) shows an example of the waveform of the motor driving control signal inputted to any one of the three input terminals of the three-phase driving motor 111. The motor driving control signal is shown as a signal which has yet to be converted into a PWM signal in the motor driving circuit 220 shown in FIG. 6. FIG. 11(B) shows an example of the waveform of a crank position angle detection signal outputted from the crank position angle detecting sensor 300 (see FIG. 6). The crank position angle detection signal is normally a signal of level "H" (High) and outputs a pulse of level "L" (Low) each time the eccentric shaft 123 passes the point at which the crank position angle is 0°. In response to this level shift, the CPU 230 determines the crank position angle "0°" and the crank position angle "θ" changing in real time.

The motor driving frequency is "f1" when the crank position angle is "0°" in FIG. 7. At this time, the driver 127, the striker 131 and the hammer bit 119 are in the state shown in FIG. 7(A).

The motor driving frequency is "f2" when the crank position angle is "50°" in FIG. 11. At this time, the driver 127, the striker 131 and the hammer bit 119 are in the state shown in FIG. 7(B).

The motor driving frequency is "f3" when the crank position angle is "90°" in FIG. 11. At this time, the driver 127, the striker 131 and the hammer bit 119 are in the state shown in FIG. 7(C).

The motor driving frequency is "f4" when the crank position angle is "180°" in FIG. 11. At this time, the driver 127, the striker 131 and the hammer bit 119 are in the state shown in FIGS. 7(E) and 7(F).

The motor driving frequency is the motor driving frequency "Fθ1" when the crank position angle is "255°" in FIG. 11. At this time, the driver 127, the striker 131 and the hammer bit 119 are in the state shown in FIG. 7(G).

The motor driving frequency is "f1" when the crank position angle is "360°" in FIG. 8, as in the case of the crank position angle of "0°". At this time, the driver 127, the striker 131 and the hammer bit 119 are in the state shown in FIG. 7(I). Thus, in the live electric hammer 101, the above-mentioned series of movement is sequentially performed in each cycle (in each turn of the driving gear 122).

As mentioned above, the striker 131 strikes the hammer bit 119 and retracts at higher speed than the driver 127 by the action of the air spring. As a result, the closed air within the cylinder bore 129*a* is strongly compressed by the striker 131. In this embodiment, the crank position angle "θ1" at which the biggest vibration is caused in the hammer 101 in the rearward direction is detected based on the information detected by the vibration sensor 500 and the crank position angle detecting sensor 300 (in this embodiment, "θ1=255°"). In order to reduce vibration caused by such pressure fluctuations, as shown in FIG. 11, when the crank position angle is in the range of about 230° to 300°, the motor driving frequency "Fθ1" is increased, so that the rotational speed of the driving motor is increased by a predetermined amount. As a result, as shown by hollow arrow in FIGS. 7(G) and 7(H), the driver 127 retracts at faster than normal speed. Therefore, the retracting speed of the striker 131 is prevented from becoming excessive with respect to the retracting speed of the driver 127. Thus, the abrupt action by the striker 131 compressing the air within the cylinder bore 129*a* can be alleviated. As a result, vibration caused in the hammer 101 can be reduced.

Further, when excessive vibration reduction causes vibration in the forward direction in the body 103 at the position of the crank position angle "θ1", the motor driving frequency "Fθ1" which has been increased by vibration reduction is decreased. In this case, in step S30, the frequency "f2" at crank position angles θ from about 10° to 80° is increased by the amount of decrease of the motor driving frequency "Fθ1". Thus, the vibration caused in the electric hammer 101 by excessive vibration reduction can be reduced.

Although in the above embodiment, the motor driving frequency F varies stepwise, the motor driving frequency F may vary continuously with time. With such construction, the rotational speed of the driving motor 111 varies in better response to the changes of the motor driving frequency F. Also in this case, it is preferable that the motor driving frequency F that has been increased by a predetermined amount is compensated for during one stroke of the driver 127 (one turn of the driving gear 122). Further, control of fluctuations of the motor driving frequency F may be performed several times in one cycle.

Further, in the second representative embodiment, only the fundamental of the vibration is extracted in step S12 of the flow chart of FIG. 8 and vibration reduction is performed based on the extracted fundamental. However, vibration reduction may also be performed further based on harmonics of the vibration as well. In this case, more effective vibration reduction can be performed.

Further, in step S27, when excessive vibration reduction control is performed, the variation ΔF of the motor driving frequency F is decreased simply by subtracting the amount of change "fx" from the variation "ΔF". However, the amount of change "Δf" to be subtracted may also be extracted from the amounts of change "fx, fy and fz", which are shown in the map of FIG. 9, based on the amplitude value "A1" of the inverted vibration fundamental.

DESCRIPTION OF NUMERALS

101 electric hammer
111 driving motor
113 driving force transmitting mechanism
115 striking mechanism
119 hammer bit
122 driving gear
123 eccentric shaft
124 crank arm
125 connecting rod
127 driver
129 cylinder
129*a* cylinder bore
131 striker
133 impact bolt
200 controller
300 crank position angle detecting sensor
500 vibration sensor

What is claimed is:

1. A power tool comprising:

a variable speed rotational driving motor controlled by a controller, a driver driven by the variable speed rotational driving motor to cyclically reciprocate, a cylinder having a wall defining a cylinder bore disposed within the power tool, the driver cyclically reciprocating within the cylinder bore, and a tool bit linearly driven by utilizing the pressure of air within the cylinder bore of the power tool, the pressure being created by the cyclical reciprocating movement of the driver within the cylinder bore, wherein the controller changes the rotational speed of the variable speed driving motor, thereby changing the cyclical reciprocation speed of the driver within the cylinder bore, thereby alleviating vibration caused by pressure fluctuation of an air compressed by the driver within the cylinder bore, wherein the rotational speed of the variable speed driving motor is increased by a predetermined amount according to the position of the driver when the driver is driven in a direction away from the tool bit, and wherein the increase of said rotational speed is compensated for by decreasing the rotational speed of the variable speed driving motor by a predetermined amount when the driver is driven in a direction toward the tool bit.

2. The power tool as defined in claim 1, wherein the rotational speed of the variable speed driving motor is changed based on an index relating to a position of the reciprocating driver.

3. The power tool as defined in claim 1, wherein the rotational speed of the variable speed driving motor is changed based on an index relating to a position of the reciprocating driver and an index relating to repulsion that the tool bit receives from the work-piece.

4. A power tool comprising:

a variable speed rotational driving motor under control of a motor controller, a driver driven by the variable speed rotational driving motor to reciprocate, a cylinder having a wall defining a cylinder bore disposed within the power tool, the driver reciprocating within the cylinder bore, and a tool bit linearly driven by utilizing the pressure of air compressed by the reciprocating movement of the driver within the cylinder bore, wherein the motor controller changes rotational speed of the variable speed driving motor based on an index relating to a position of the reciprocating driver; wherein the rotational speed of the variable speed driving motor is increased by a predetermined amount according to the position of the driver when the driver is driven in a direction away from the tool bit, and wherein the increase of said rotational speed is compensated for by decreasing the rotational speed of the variable speed driving motor by a predetermined amount when the driver is driven in a direction toward the tool bit.

5. The power tool as defined in claim 4, further comprising a driving force transmitting mechanism that converts a rotating output of the variable speed driving motor to a reciprocating movement via a crank arm and transmits the reciprocating movement to the driver, wherein the index relating to the position of the reciprocating driver includes information about the angle of rotation of the crank arm.

6. The power tool as defined in claim 4, further comprising a cylinder and a striker, wherein the driver is slidably disposed within one end region of the cylinder and the striker is slidably disposed within the other end region of the cylinder, and wherein air pressure within the cylinder fluctuates by sliding movement of the driver within the cylinder such that the striker causes the tool bit to perform a hammering operation.

7. A power tool, including:

a variable speed driving motor under control of a motor controller, a driver driven by the variable speed driving motor that reciprocates based on rotation provided by the variable speed driving motor, a cylinder having a wall defining a cylinder bore disposed within the power tool, the driver reciprocating within the cylinder bore, a tool bit linearly driven by utilizing the pressure of air in the cylinder bore that has been compressed by the reciprocating movement of the driver, wherein the motor controller changes rotational speed of the variable speed driving motor based on an index relating to a position of the reciprocating driver and an index relating to repulsion that the tool bit receives from a work-piece, and a striker to drive the tool bit, wherein air within an air chamber defined between the driver and the striker is compressed by the reciprocating movement of the driver, and the striker is linearly driven by the pressure of the compressed air, whereby the tool bit is linearly driven, and wherein the index relating to the repulsion that the tool bit receives from the work-piece is defined by a speed at which the striker moves in a direction away from the tool bit after driving the tool bit.

8. The power tool as defined in claim 7, further comprising a vibration sensor disposed in a body of the power tool, wherein the vibration sensor detects vibration information within the body and the power tool utilizes the detected information as the index relating to the repulsion that the tool bit receives from the work-piece.

9. A power tool, including:

a variable speed driving motor under control of a motor controller, a driver driven by the variable speed driving motor that reciprocates based on rotation provided by the variable speed driving motor, a cylinder having a wall defining a cylinder bore disposed within the power tool, the driver reciprocating within the cylinder bore, and a tool bit linearly driven by utilizing the pressure of air in the cylinder bore that has been compressed by the reciprocating movement of the driver, wherein the motor controller changes rotational speed of the variable speed driving motor based on an index relating to a position of the reciprocating driver and an index relating to repulsion that the tool bit receives from the work-piece, wherein the rotational speed of the variable speed driving motor is increased by a predetermined amount, according to the index relating to the position of the reciprocating driver and the index relating to the repulsion that the tool bit receives from the workpiece, when the driver is driven in the direction away from the tool bit, and wherein the increase of said rotational speed is compensated for by decreasing the rotational speed of the variable speed driving motor by a predetermined amount when the driver is driven in a direction toward the tool bit.

* * * * *